US005154541A

United States Patent [19]

Boren et al.

[11] Patent Number: 5,154,541

[45] Date of Patent: Oct. 13, 1992

[54] MODULAR EARTH SUPPORT SYSTEM

[75] Inventors: Joseph L. Boren, Framingham; Richard P. Dixon, Northboro, both of Mass.

[73] Assignee: Metcalf & Eddy Technologies, Inc., Northboro, Mass.

[21] Appl. No.: 791,111

[22] Filed: Nov. 12, 1991

[51] Int. Cl.[5] ..... E02D 17/04

[52] U.S. Cl. ..... 405/272; 405/282

[58] Field of Search ..... 405/272, 282, 283, 133, 405/149, 276, 281

[56] References Cited

U.S. PATENT DOCUMENTS

| | | | |
|---|---|---|---|
| 1,199,168 | 9/1916 | Fisher | 405/282 |
| 1,880,316 | 10/1932 | Dancer | 405/272 |
| 2,260,423 | 10/1941 | Washbourne | 405/272 |
| 4,259,029 | 3/1981 | Koehl | 405/282 |
| 4,372,709 | 2/1983 | Krings | 405/282 |
| 4,472,090 | 9/1984 | Krings | 405/272 |
| 4,659,260 | 4/1987 | Morelli | 405/283 |
| 4,685,837 | 8/1987 | Cicanese | 405/282 |
| 4,850,747 | 7/1989 | Morelli | 405/283 |

*Primary Examiner*—David H. Corbin

*Attorney, Agent, or Firm*—Lahive & Cockfield

[57] ABSTRACT

An apparatus for shoring an excavation site includes a plurality of interlocking panels. Each panel includes inner and outer plates spaced apart from one another by beam supports. The panels have a bottom cutting edge for anchoring in the soil forming the bottom of the excavation site. Ball or socket joints are disposed, one each, along opposed vertical edges of each panel so that adjacent panels can be interlocked. A plurality of wales are provided for additional support. A method for shoring an excavation site includes the steps of interlocking a set of panels to enclose a space corresponding to the excavation site and installing the interlocked panels in the site. Sets of wales are then installed adjacent the inner plates of the panels for additional support.

7 Claims, 5 Drawing Sheets

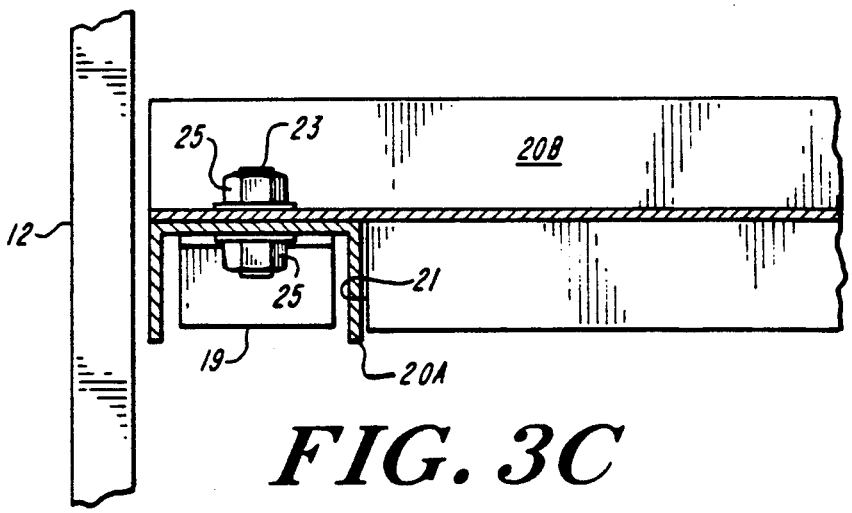
FIG. 3C
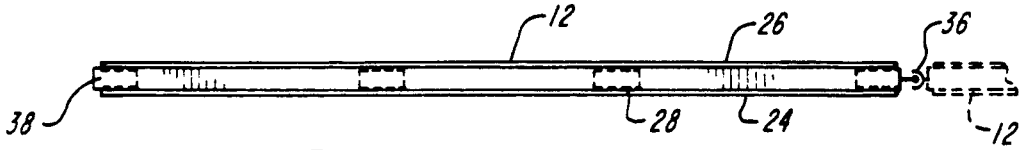
FIG. 4A
FIG. 4B
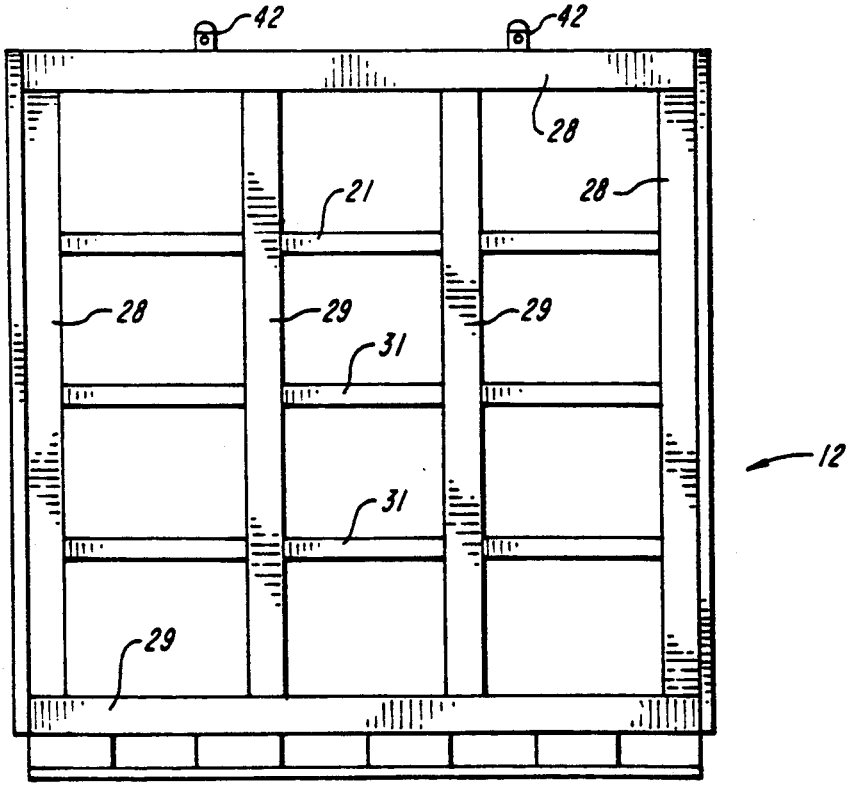

MODULAR EARTH SUPPORT SYSTEM

BACKGROUND OF THE INVENTION

The present invention generally relates to the construction industry and, in particular, to a method and apparatus for shoring of open excavation sites.

Excavation workers are exposed to many hazards perhaps the chief of which is the danger of cave-ins. As a result, the United States Department of Labor Occupational Safety and Health Administrations (OSHA) requires that all excavations be prepared for the protection of employees exposed to potential cave-ins. Acceptable excavation site preparations include sloping or benching of the sides of the excavation, supporting the sides of the excavation, or placing a shield between the side of the excavation and the work area.

Each of these methods of protecting workers is dependent upon factors such as soil classification, depth of cut, water content of the soil, changes due to weather and climate, and other operations in the vicinity of the excavation. It can be dangerous, therefore, to design a system for protecting workers which meets only minimum standards. This is because over time, conditions which prevail when a system is designed can change, rendering the designed system insufficient for later prevailing conditions.

A typical operation requiring excavation and, therefore, protection of workers at the excavation site is the installation of underground storage tanks. These tanks are manufactured in various sizes. Typically, oil companies install three 10,000 gallon double wall fiberglass tanks at a location where oil is to be stored. Presently, the tanks are installed by a procedure which includes excavating a tank hole which is approximately thirty-six feet long by thirty-two feet wide by fourteen feet deep. Depending on a given application, the excavation of the new tank hole may be preceded by the removal of old storage tanks already in place. In any case, once the new tank hole is excavated, a twelve inch thick concrete pad is poured to which the tanks are anchored. On top of the concrete pad a twelve inch thick layer of peastone is placed. The new tanks are installed over the peastone and the excavated site is backfilled to grade.

A known method for shoring an operation such as this includes driving sheet piling in a rectangle approximately thirty feet by thirty-six feet by twenty feet deep. Once this is completed, a tank installer excavates inside the rectangular shoring to a depth of approximately fourteen feet below grade. The site is then prepared and the tanks installed similarly to the manner described above. After tank installation, the rectangular shoring is either cut down to about five feet below grade and buried during backfilling or it is removed from the ground. This method of shoring an excavation site is very time consuming and expensive, typically costing between forty and fifty thousand dollars and adding three days to a tank replacement project.

Another method for shoring an excavation site is described in U.S. Pat. No. 4,685,837 (Cicanese, Aug. 11, 1987). This patent describes a multi-sided portable trench and pit form system having at least two panels forming each side. The panels are releasably interconnectable along the vertical margins of each adjacent panel and side. It is a lightweight system that is typically assembled inside of the excavation site. As a result, in addition to exposing workers to the risk of cave-in during assembly of the shoring system, the system is not suitable for excavations where soil conditions dictate the need for high strength shoring.

It is, therefore, an object of the invention to provide a method and apparatus for shoring an excavation site that can be quickly and inexpensively practiced while providing high strength protection against cave-ins. It is another object of the invention to provide such an apparatus that can be recycled for multiple uses.

SUMMARY OF THE INVENTION

These and other objects are achieved by the present invention which features a system for shoring an open excavation site including a plurality of generally rectangular steel reinforced panels that interlock with one another along their vertical edges. The panels are configured so that they can be assembled to form rectangles suitable for shoring typical excavation sites such as those discussed above.

In one embodiment of the invention, each panel includes inner and outer plates maintained in spaced apart relation to one another by tubular steel supports positioned therebetween. Some of the tubular steel supports are further strengthened by interior timber disposed within the tubular steel. Opposed vertical sides of each panel are provided, one each, with a ball or socket joint to facilitate the connection of adjacent panels for preassembling the system.

Each panel further includes a bottom cutting edge defined by the panel's lower horizontal edge. This cutting edge is driven into the bottom surface of the excavation site for anchoring the modular earth support system in place. In one embodiment of the invention, each panel also includes lifting eyes disposed along the panel's upper edge. These lifting eyes facilitate the installation and removal of the system to and from the excavation site.

In accordance with the teachings of the invention, once a plurality of rectangle forming panels have been installed in an excavated site, horizontal support beams, or wales, are installed along the interior plates of the panels for increased support. The panels include flanges for receiving these wales. In a typical installation, two sets of four wales each are installed. Each set of wales includes one wale for each side of the rectangle formed by the panels. These wales, in addition to the cutting edge of each panel, prevent adjacent panels from pivoting in relation to one another.

In another embodiment, the invention features a method for shoring an open excavation site. The method includes the steps of preparing an excavation site such as by, for example, digging a trench or pit. Once the site is prepared, a set of panels are interlocked with one another and arranged inside the soil walls defining the trench or pit. Wales are positioned inside the panels to further support the panels against the force exerted on the panels by the surrounding soil. Once the panels are anchored in place, construction personnel can safely enter the excavated area. At the completion of excavation, the wales and panels are removed and the site backfilled to grade.

These and other features of the invention will be more fully appreciated by reference to the following detailed description which is to be read in conjunction with the attached drawing.

BRIEF DESCRIPTION OF THE DRAWING

FIG. 4A is a plan view of one embodiment of a panel utilized in connection with the modular earth support system depicted in FIG. 1, FIG. 4B is an elevation view of the panel depicted in FIG. 4A.

DETAILED DESCRIPTION

In one aspect, the invention features an apparatus for shoring an excavation site including a plurality of interlocking panels arranged to enclose the site. The apparatus is typically delivered to the site on heavy moving equipment, such as a flat bed truck, and assembled and installed in the excavated area.

Figure 1:
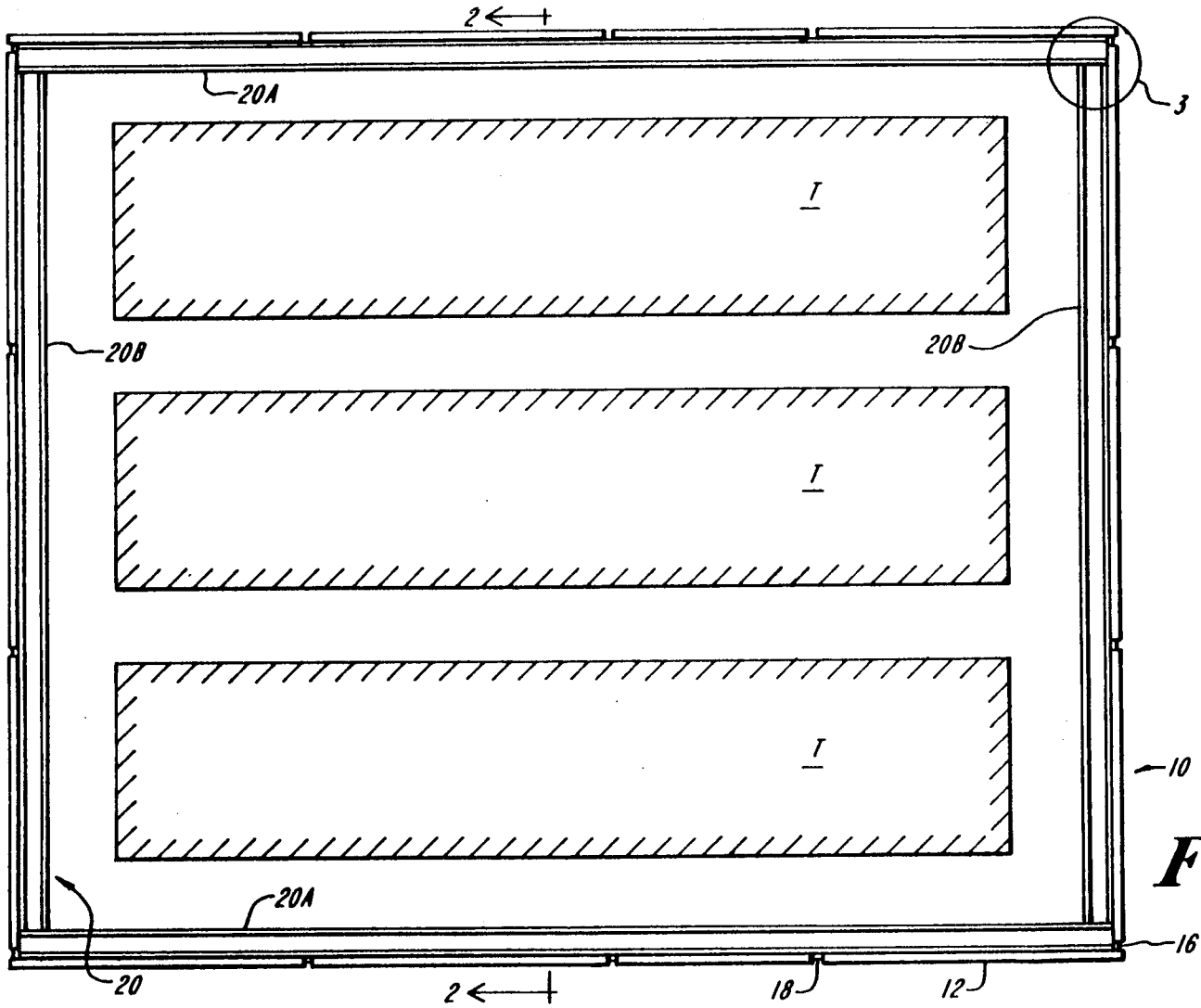
FIG. 1 is a plan view of a typical modular earth support system constructed in accordance with the teachings of the present invention.

FIG. 1 shows a modular earth support structure 10 which includes a plurality of panels 12 surrounding three underground storage tanks T. The panels 12 of the illustrated assembled structure can be of various dimensions and arranged in various ways for providing a structure of a specified dimension dependent upon the size and number of tanks T. The panels are joined linearly by joints 18 and perpendicularly by joints 16. These joints are described in greater detail herein below. For added support, installed inside of the panels 12 are two sets of wales 20 only one of which is visible in FIG. 1. Visible in FIG. 2, however, is that in the illustrated embodiment two sets of horizontally disposed wales 20 are utilized.

Figure 2:
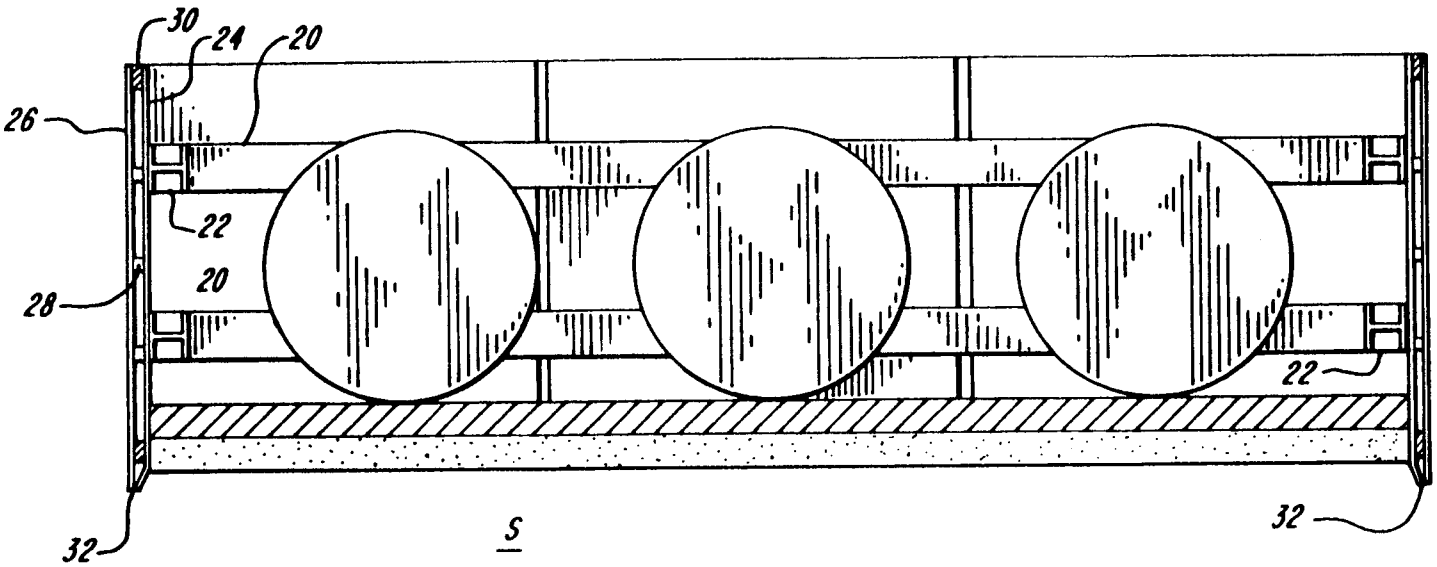
FIG. 2 is a cross-section view taken along line 2—2 of FIG. 1, FIGS. 3A through 3C are detailed views of area 3 of FIG. 1.
Figure 3A:
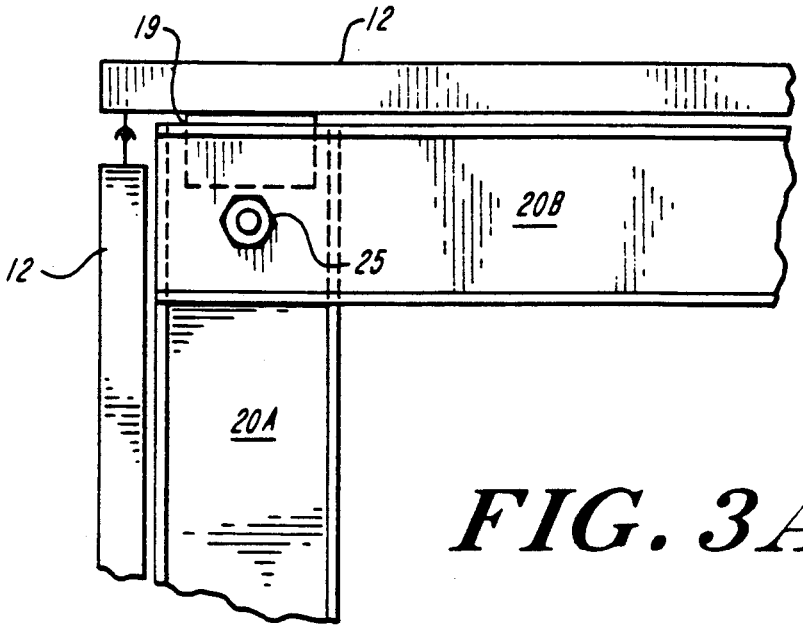
Figure 3B:
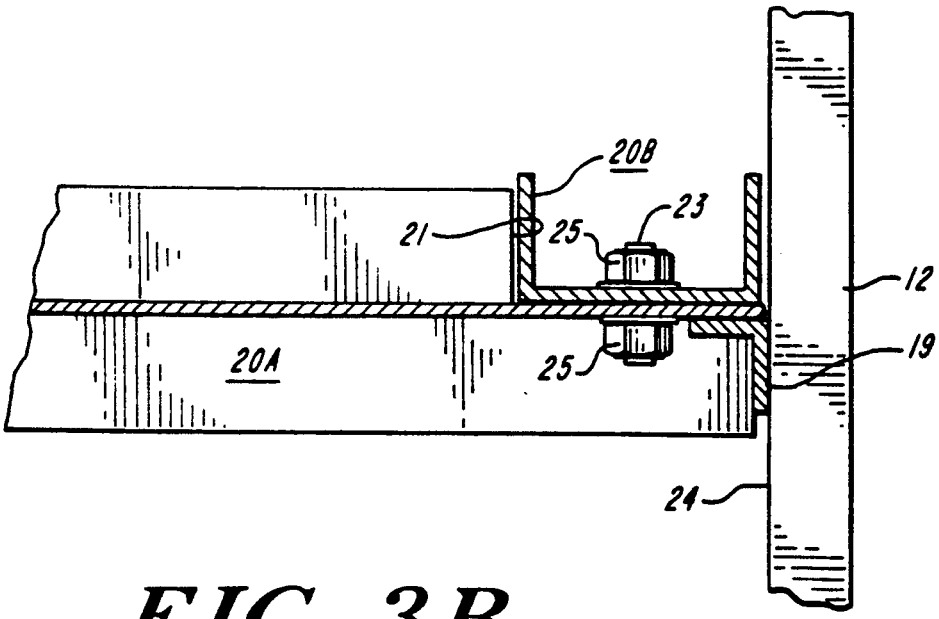

In the illustrated embodiment of the structure, each set of wales 20 includes two long wales 20A and two short wales 20B. In installations wherein the panels 12 are dimensioned and arranged so as to provide a square structure, as opposed to the illustrated rectangular structure 10, the wales will be of equal length. As illustrated in FIGS. 3A-3C, each of the wales 20A and 20B is notched at each end 22 for engagement with its adjoining perpendicularly disposed counterpart 20B and 20A respectively. This arrangement provides a secure connection that effectively reinforces the outer panel perimeter. As shown in FIG. 2, the wales 20A and 20B have an "I" shaped profile as do standard steel beams generally known in the art. As shown in FIGS. 3A through 3C, an L-shaped beam seat 19 is welded to the inner plate 24 of one of the panels 12 and supports lower wale 20A which has, at its end, its upper flanges 21 notched out. Adjacent wale 20B similarly has at its end its lower flanges 23 notched out so that wales 20A and 20B can engage one another. Standard securement apparatus such as bolt 23 and nuts 25 rigidly secure the wales to one another. Wales formed of W14×GR50 steel perform well.

As shown in FIG. 4A, each panel 12 includes a panel inner plate 24 and a panel outer plate 26 maintained in parallel relationship to one another by a skeletal structure formed in large part of tubular steel braces 28. Some of the braces 28 are further reinforced with interior timbers 30. This construction for the panel 12 provides an extremely durable assembly. The bottom of each panel is deformed into a cutting edge 32 to facilitate the seating of the structure 10 into the virgin soil S beneath the excavation site.

FIG. 4B is a detailed elevation of the skeletal structure of a typical panel assembly 12 and shows that the infrastructure typically includes an array of tubular steel braces 28 which are reinforced with interior timbers (not shown). The skeletal structure 12 also includes several tubular steel braces 29 that are not reinforced with interior timber. Further included as part of the panel skeletal structure are smaller, horizontally disposed, tubular steel braces 31. The tubular steel braces 28 and 29 are typically secured to inner panel 24 and outer panel 26 by known techniques such as groove or slot welds. It has been found that for the braces 28 and 29 4×8×0.250 A500, grade C steel is suitable and that for braces 31 4×4×0.188 A500 grade C steel is suitable.

Disposed on opposed vertical edges of the panel 12 are, one on each edge, a ball joint 36 and a socket joint 38 for interlocking adjoining panels 12 to form the perimeter of the structure 10. The ball joint 36 and socket joint 38 can be cut, for example, from Bethlehem PZ-27 steel sheet piling and attached to the edge of the panel 12 using either a full penetration or groove weld. FIG. 4A also shows, in phantom, an adjoining panel 12 having a socket joint interlocking with the ball joint 36.

Figure 5A:
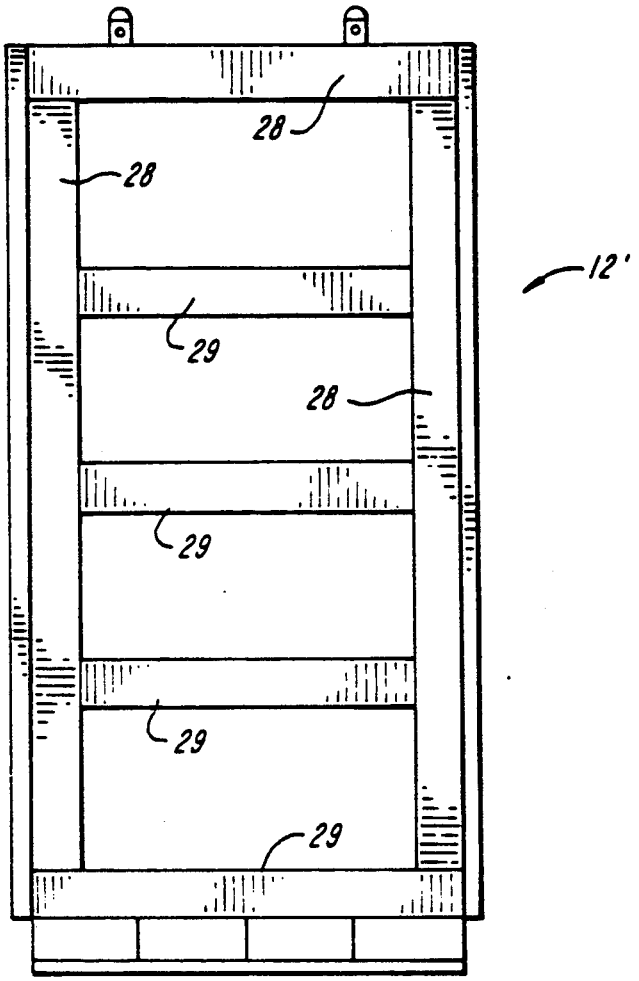
FIG. 5A is a plan view of another embodiment of a panel utilized in connection with the modular earth support system depicted in FIG. 1.
Figure 5B:
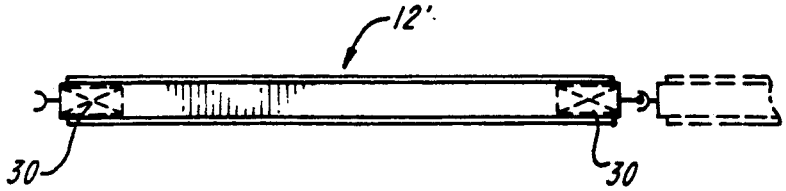
FIG. 5B is an elevation view of the panel depicted in FIG. 5A.

FIGS. 5A and 5B shows a detailed view of the skeletal structure of another embodiment of the panel 12. Therein, a panel 12' is significantly narrower than the panel 12. The skeletal structure of the panel 12' includes tubular steel braces 28 and 29. FIG. 5B shows that the vertically disposed braces 28 include interior timbers 30 for added support. The upper, horizontally disposed, brace 28 also typically includes an interior timber.

For installation, the unassembled structure 10 is delivered to the work site after initial excavation of a pit or trench. Typically, the structure is delivered to the site on flat bed trucks. Heavy lifting equipment, such as a crane, is needed to install the panels 12 that interlock with one another as described above, to form the required rectangle. The panels 12 and 12' are installed so that their cutting edges 32 seat in the unexcavated virgin soil S that forms the floor of the excavation site. Once the panels 12 are in place, the wales 20 for further support. The excavation site is then backfilled with a 1:1 slope to the natural grade. Once this has been performed, construction personnel may safely enter the excavated area inside of the structure 10.

At a typical work site, a twelve inch thick concrete pad 34 is poured over the unexcavated floor inside of the structure 10 and twelve inches of peastone 36 is placed over the concrete pad 34. The tanks T can then be installed and the site backfilled to the top of the tanks. Once the site has been backfilled, a crane removes the assembled panels via lifting eyes 42. The system is then broken down and stored for re-use.

It should be understood that while specific embodiments of the invention have been described in detail, various alterations which are intended to be embraced within the spirit and scope of the invention will be apparent to those skilled in the art. The invention is to be defined, therefore, not by the preceeding description but by the claims that follow.

What is claimed is:

1. Heavy duty apparatus for shoring an excavation site over a broad range of soil conditions and for being assembled from outside of the excavation site, the apparatus, comprising A. a plurality of interlocking panels arranged to circumscribe a space, each of said panels including i) a bottom, cutting edge for embedding the panel in the floor of the excavation site, ii) an inner plate and an outer plate spaced apart from one another to define a panel space therebetween, iii) a plurality of spaced apart beam supports disposed within said panel space, and iv) ball and socket joints affixed, one each, to opposed vertical edges of each panel, for mutual engagement, B. a plurality of wales, arranged in a position against said panel inner plates for countering a force acting in a direction toward said space and exerted on said panels from outside of said space; and C. means for maintaining said plurality of wales in said position.

2. Apparatus of claim 1 wherein selected ones of said panels further comprise a tab for lifting said panel from said excavation site.

3. Apparatus of claim 1 wherein said plurality of beam supports include vertically and horizontally disposed beam supports.

4. Apparatus of claim 1 wherein said beam support comprise tubular steel.

5. Apparatus of claim 4 wherein said tubular steel includes interior timber.

6. Apparatus of claim 1 wherein said means for maintaining said wales in said position comprise L-shaped flanges secured to said inner panel plates.

7. A method of shoring an open excavation site from outside of the excavation site over a broad range of soil conditions, the method comprising the steps of:

A. interlocking a set of panels to enclose a space corresponding to the excavation site, said panels including:

i) a bottom, cutting edge for embedding the panel in the floor of the excavation site, ii) an inner plate and an outer plate spaced apart from one another to define a panel space therebetween, iii) a plurality of spaced apart beam supports disposed within said panel space, and iv) ball and socket joints affixed, one each, along opposed vertical edges of each panel, for mutual engagement, B. placing the interlocked panels in the excavation site; and C. installing a plurality of wales adjacent said panel inner plates for countering a force acting in a direction toward said space and exerted on said panels from outside of said space.

* * * * *